US009903104B2

(12) United States Patent
Welliver

(10) Patent No.: US 9,903,104 B2
(45) Date of Patent: Feb. 27, 2018

(54) DIRT SHIELD SYSTEM

(71) Applicant: Michelle Welliver, Fort Morgan, CO (US)

(72) Inventor: Michelle Welliver, Fort Morgan, CO (US)

( * ) Notice: Subject to any disclaimer, the term of this patent is extended or adjusted under 35 U.S.C. 154(b) by 275 days.

(21) Appl. No.: 14/833,212

(22) Filed: Aug. 24, 2015

(65) Prior Publication Data

US 2017/0058502 A1 Mar. 2, 2017

(51) Int. Cl.
*E03D 11/13* (2006.01)
*A47K 17/02* (2006.01)

(52) U.S. Cl.
CPC ..... *E03D 11/13* (2013.01); *A47K 17/02* (2013.01)

(58) Field of Classification Search
CPC ..... E03D 11/13; A47K 17/02; A47K 13/00; A47K 13/02
USPC ..... 4/901
See application file for complete search history.

(56) References Cited

U.S. PATENT DOCUMENTS

| | | | | |
|---|---|---|---|---|
| 1,641,029 | A | 8/1927 | Guadet | |
| 2,187,676 | A | 1/1940 | Biewen | |
| 2,771,613 | A | 11/1956 | Markiewicz | |
| 3,085,611 | A * | 4/1963 | Dolnick | A47K 13/24 4/901 |
| 4,285,075 | A | 8/1981 | Nelson | |
| 5,067,185 | A | 11/1991 | Kohler | |
| 5,560,049 | A * | 10/1996 | Robinson | A47K 13/242 4/901 |
| 5,581,824 | A * | 12/1996 | Crook, Sr. | A47K 13/242 4/901 |
| 6,174,581 | B1 | 6/2001 | Barker | |
| D642,003 | S | 7/2011 | Wright | |
| 2013/0022775 | A1 | 1/2013 | Dye | |
| 2013/0209721 | A1 | 8/2013 | Mahasa | |

* cited by examiner

*Primary Examiner* — Tuan N Nguyen

(57) ABSTRACT

A dirt shield system for enhancing cleanliness of a toilet includes a toilet that has a pedestal, a bowl and a tank. A cover is provided and the cover is removably wrapped around the toilet. The cover is positioned to cover the bowl and the pedestal. Thus, the cover prevents the bowl and the pedestal from becoming soiled.

9 Claims, 5 Drawing Sheets

DIRT SHIELD SYSTEM

BACKGROUND OF THE DISCLOSURE

Field of the Disclosure

The disclosure relates to shield devices and more particularly pertains to a new shield device for enhancing cleanliness of a toilet.

SUMMARY OF THE DISCLOSURE

An embodiment of the disclosure meets the needs presented above by generally comprising a toilet that has a pedestal, a bowl and a tank. A cover is provided and the cover is removably wrapped around the toilet. The cover is positioned to cover the bowl and the pedestal. Thus, the cover prevents the bowl and the pedestal from becoming soiled.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
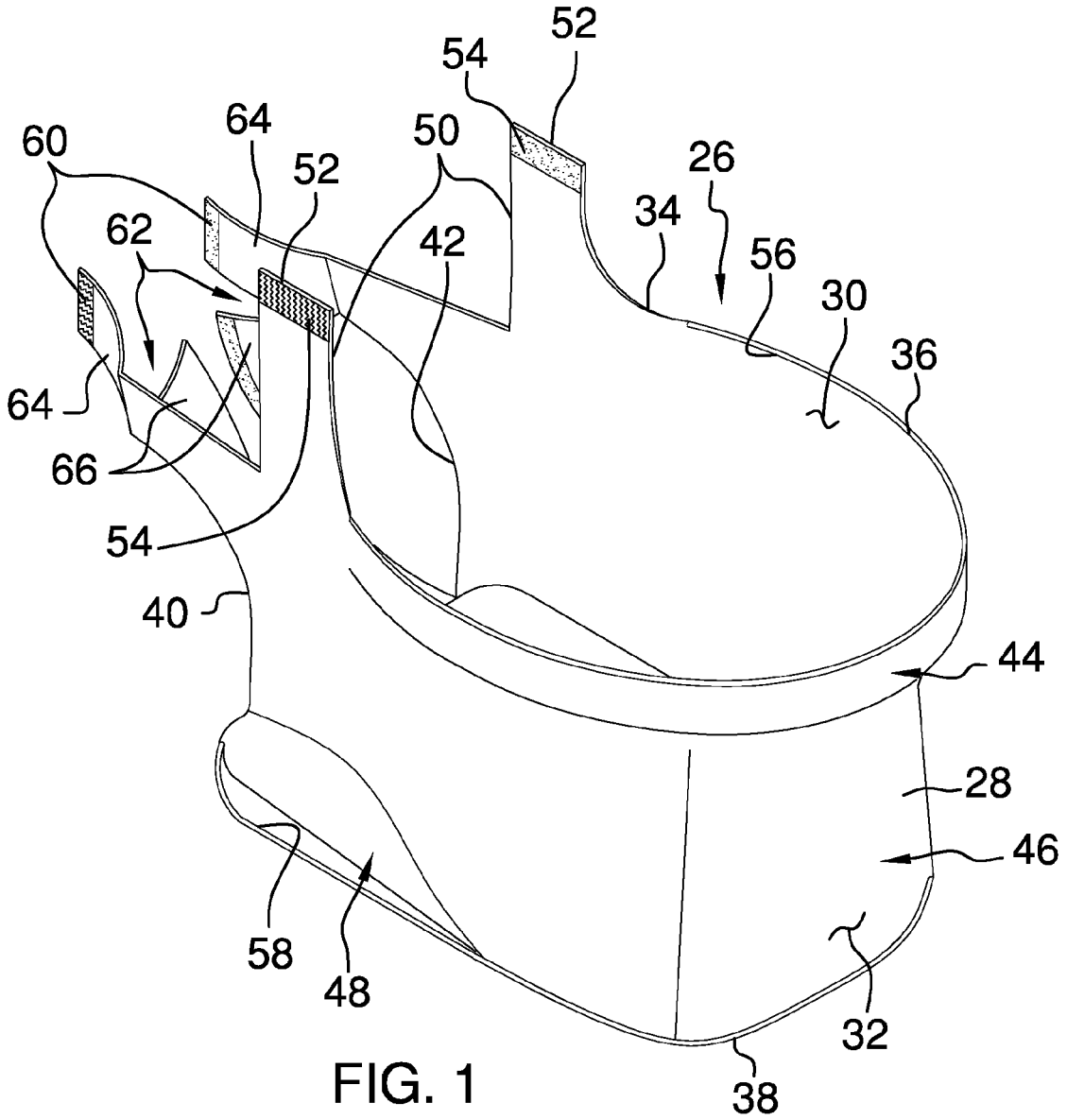
FIG. 1 is a perspective view of a dirt shield system according to an embodiment of the disclosure.
Figure 2:
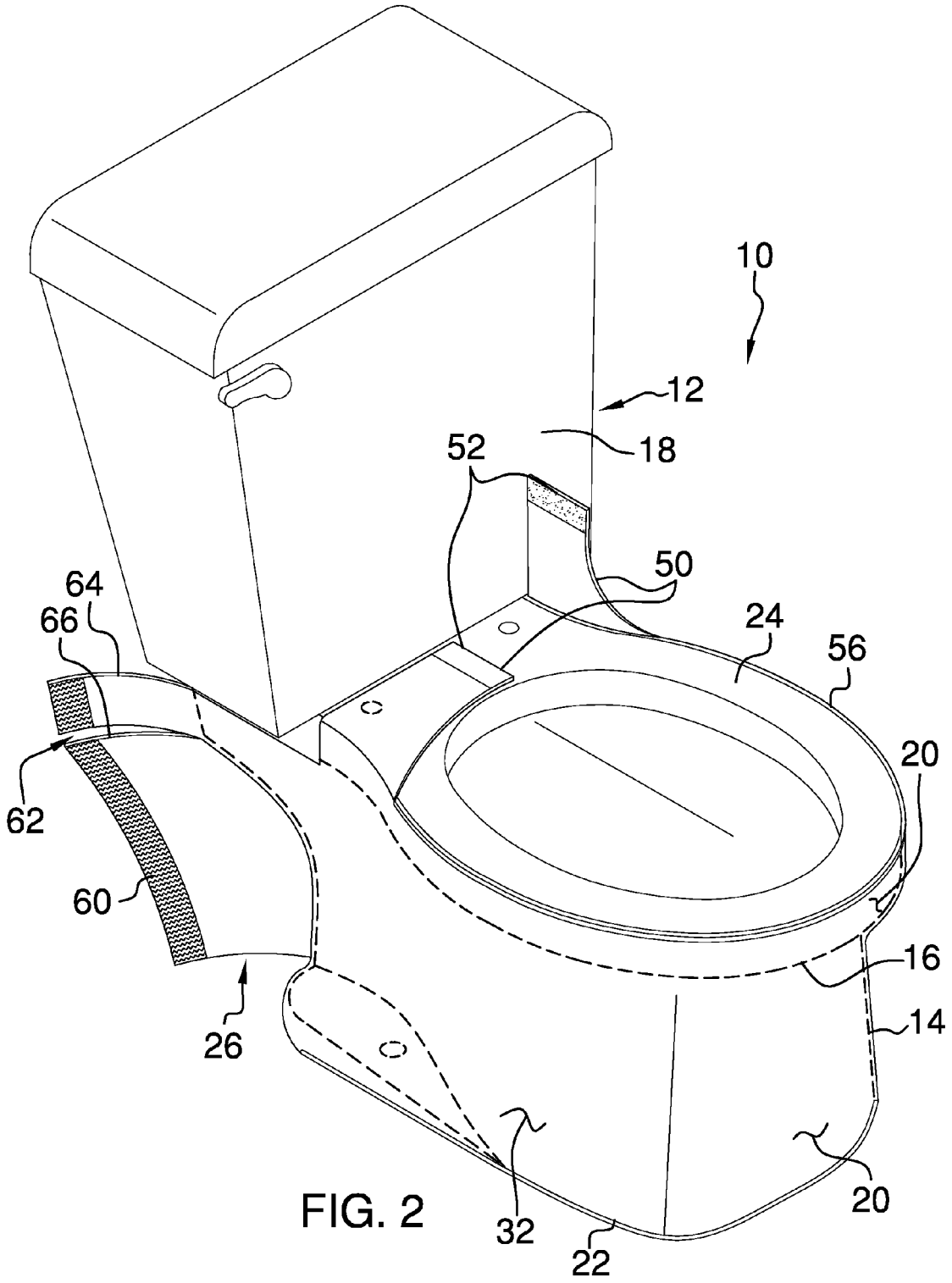
FIG. 2 is a top perspective view of an embodiment of the disclosure.
Figure 3:
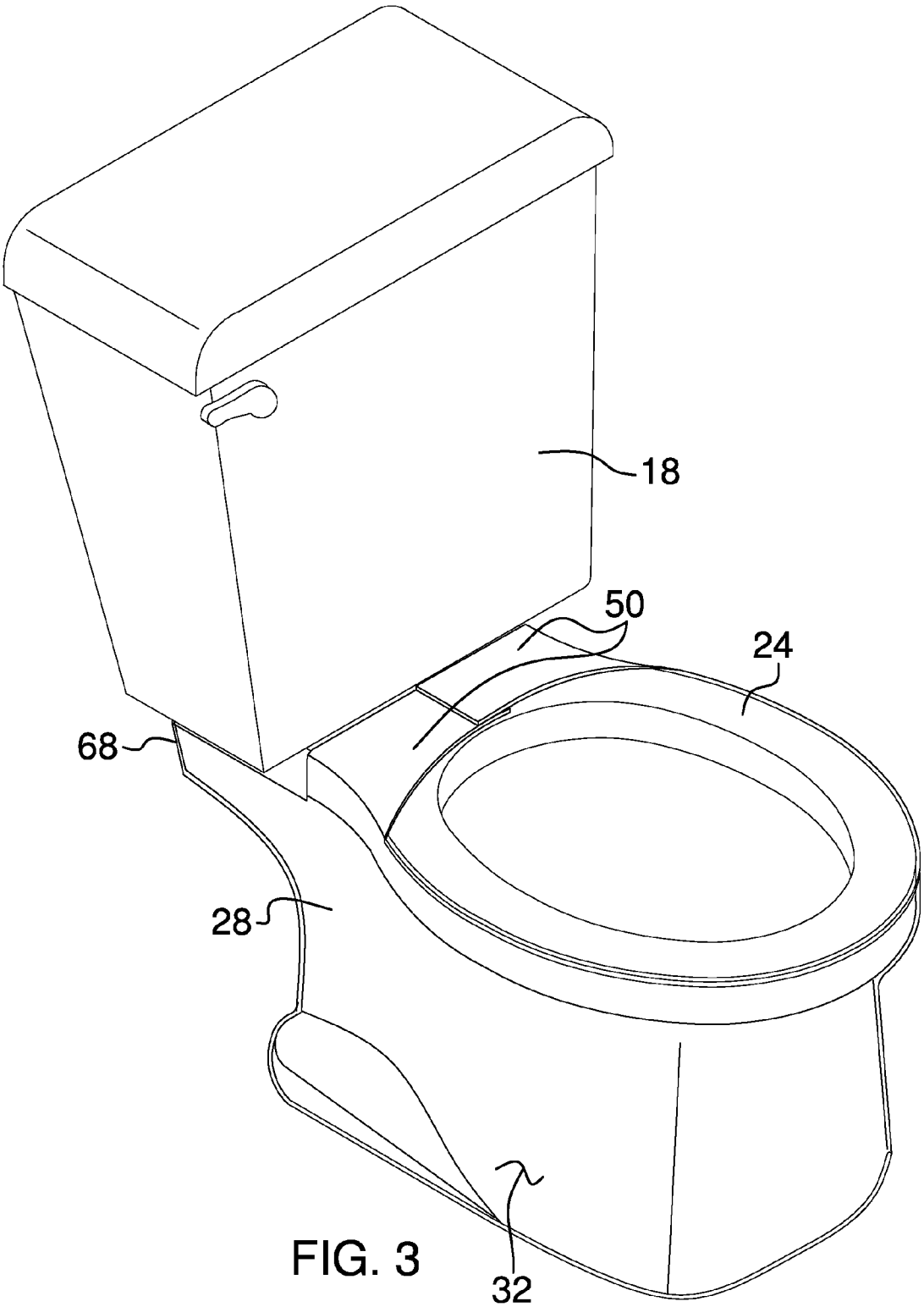
FIG. 3 is a right side perspective view of an embodiment of the disclosure.
Figure 4:
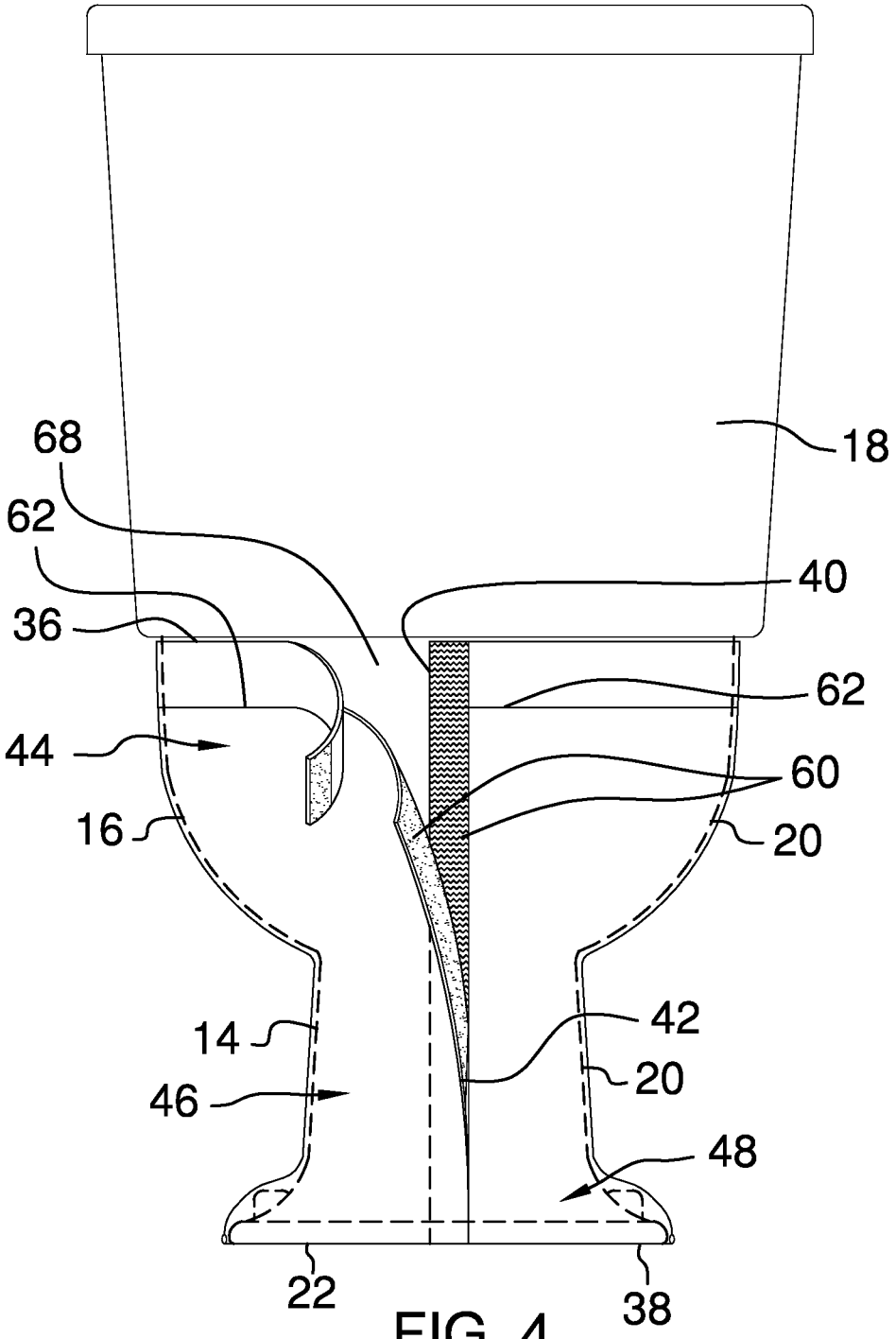
FIG. 4 is a back view of an embodiment of the disclosure.
Figure 5:
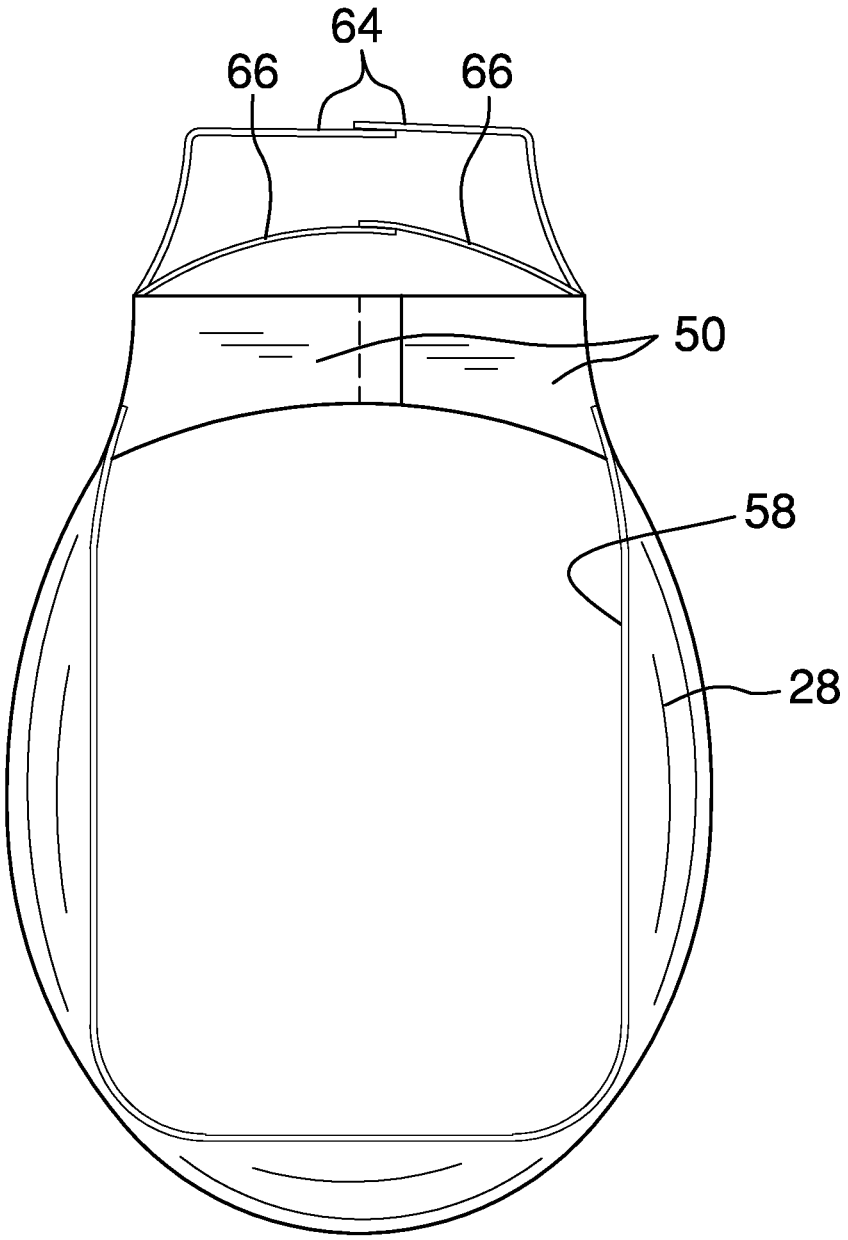
FIG. 5 is a bottom view of an embodiment of the disclosure.

With reference now to the drawings, and in particular to FIGS. 1 through 5 thereof, a new shield device embodying the principles and concepts of an embodiment of the disclosure and generally designated by the reference numeral 10 will be described.

As best illustrated in FIGS. 1 through 5, the dirt shield system 10 generally comprises a toilet 12 that has a pedestal 14, a bowl 16 and a tank 18. The bowl 16 extends upwardly from the pedestal 14 and each of the pedestal 14 and the bowl 16 has an outer surface 20. The pedestal 14 has a lower edge 22 and the bowl 16 has a distal edge 24 with respect to the pedestal 14. The toilet 12 may comprise a plumbing fixture utilized in the convention of urination and defecation.

A cover 26 is provided and the cover 26 is removably wrapped around the toilet 12. The cover 26 is positioned to cover the bowl 16 and the pedestal 14 such that the cover 26 may prevent the bowl 16 and the pedestal 14 from becoming soiled. The cover 26 comprises a panel 28 that has a first surface 30, a second surface 32 and a peripheral edge 34 extending between the first surface 30 and the second surface 32. The panel 28 may comprise a fluid impermeable and flexible material such as vinyl or the like.

The peripheral edge 34 has a top side 36, a bottom side 38, a first lateral side 40 and a second lateral side 42. The panel 28 is curved between the first lateral side 40 and the second lateral side 42 such that the panel 28 has a U-shaped cross section taken along a line extending between the top side 36 and the bottom side 38. The first lateral side 40 and the second lateral side 42 are matable when the panel 28 is wrapped around the toilet 12.

The panel 28 has a bowl portion 44, a pedestal portion 46 and a base portion 48. The bowl portion 44 extends between the pedestal portion 46 and the top side 36. The bowl portion 44 curves outwardly between the pedestal portion 46 and the top side 36. The base portion 48 extends between the pedestal portion 46 and the bottom side 38. The base 48 portion curves outwardly between the pedestal portion 46 and the bottom side 38.

A pair of first straps 50 is provided and each of the first straps 50 extends upwardly from the top side 36. Each of the first straps 50 is positioned proximate an associated one of the first lateral side 40 and the second lateral side 42. Each of the first straps 50 is wrapped around the toilet 12 such that each of the first straps 50 extends between the bowl 16 and the tank 18. Each of the first straps 50 has a distal end 52 with respect to the top side 36. The distal end 52 of each of the first straps 50 is matable such that the panel 28 is removably retained on the toilet 12.

A pair of first couplers 54 is provided and each of the first couplers 54 is coupled to an associated one of the first straps 50. Each of the first couplers 54 is positioned adjacent to the distal end 52 of the associated first strap 50. Each of the first couplers 54 is complementary and each of the first couplers 54 may comprise a hook and loop fastener or the like.

A first elastic member 56 is coupled to the panel 28 and the first elastic member 56 is coextensive with the top side 36. The first elastic member 56 urges the top side 36 to frictionally engage the toilet 12 such that the panel 28 is removably retained on the toilet 12. A second elastic member 58 is coupled to the panel 28 and the second elastic member 58 is coextensive with the bottom side 38. The second elastic member 58 urges the bottom side 38 to frictionally engage the toilet 12 such that the panel 28 is removably retained on the toilet 12.

A pair of second couplers 60 is provided and each of the second couplers 60 is coupled to the panel 28. Each of the second couplers 60 is coextensive with an associated one of the first lateral side 40 and the second lateral side 42. Each of the second couplers 60 is complementary such that the panel 28 is removably retained on the toilet 12. Each of the second couplers 60 may comprise a hook and loop fastener or the like.

The panel 28 has a pair of cuts 62 and each of the cuts 62 extends inwardly from an associated one of the first lateral side 40 and the second lateral side 42. Each of the cuts 62 is spaced from the top side 36 to define a pair of second straps 64 and a pair of third straps 66. Each of the second straps 64 and the third straps 66 are wrapped around a back side 68 of the pedestal 14 such that the panel 28 is removably retained on the toilet 12.

In use, the panel 28 is wrapped around the toilet 12 such that the first surface 30 corresponding to the bowl portion 44 abuts the outer surface 20 corresponding to the bowl 16 and the first surface 30 corresponding to the pedestal portion 46 abuts the outer surface 20 corresponding to the pedestal 14. The top side 36 is positioned to be coextensive with the distal edge 24 of the bowl 16 and the bottom side 38 is positioned to be coextensive with the lower edge 22 of the pedestal 14. Thus, the panel 28 completely covers the outer surface 20 corresponding to the pedestal 14 and the bowl 16. The panel 28 is removed when the panel 28 becomes soiled thereby facilitating the panel 28 to be cleaned. The panel 28 prevents the outer surface 20 corresponding to the bowl 16 and the pedestal 14 from becoming soiled.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A dirt shield system comprising:

a toilet having a pedestal, a bowl and a tank; and a cover being removably wrapped around said toilet, said cover being positioned to cover said bowl and said pedestal wherein said cover is configured to prevent said bowl and said pedestal from becoming soiled, said cover comprising a panel, said panel being flexible, said panel having a first surface, a second surface and a peripheral edge extending between said first surface and said second surface, said peripheral edge having a top side, a bottom side, a first lateral side and a second lateral side, said panel being curved between said first lateral side and said second lateral side such that said panel has a U-shaped cross section taken along a line extending between said top side and said bottom side;

a pair of first straps, each of said first straps extending upwardly from said top side, each of said first straps being positioned proximate an associated one of said first lateral side and said second lateral side; and a first elastic member being coupled to said panel, said first elastic member being coextensive with said top side, said first elastic member urging said top side to frictionally engage said toilet such that said panel is removably retained on said toilet.

2. The system according to claim 1, wherein said bowl extends upwardly from said pedestal, each of said pedestal and said bowl having an outer surface, said pedestal having a lower edge, said bowl having a distal edge with respect to said pedestal.

3. The system according to claim 1, wherein said panel has a bowl portion, a pedestal portion and a base portion, said bowl portion extending between said pedestal portion and said top side, said bowl portion curving outwardly between said pedestal portion and said top side, said base portion extending between said pedestal portion and said bottom side, said base portion curving outwardly between said pedestal portion and said bottom side.

4. The system according to claim 3, wherein:

said bowl has an outer surface and a distal edge;

said panel has an outer surface and a lower edge; and said panel is wrapped around said toilet such that said first surface corresponding to said bowl portion abuts said outer surface corresponding to said bowl, said first surface corresponding to said pedestal portion abutting said outer surface corresponding to said pedestal, said top side being coextensive with said distal edge of said bowl, said bottom side being coextensive with said lower edge of said pedestal such that said panel completely covers said outer surface corresponding to said bowl and said pedestal, said first lateral side and said second lateral side being matable when said panel is wrapped around said toilet.

5. The system according to claim 1, wherein each of said first straps being wrapped around said toilet such that each of said first straps extends between said bowl and said tank, each of said first straps having a distal end with respect to said top side, said distal end of each of said first straps being matable such that said panel is removably retained on said toilet.

6. The system according to claim 1, further comprising a pair of first couplers, each of said first couplers being coupled to an associated one of said first straps, each of said first couplers being positioned adjacent to said distal end of said associated first strap, each of said first couplers being complementary.

7. The system according to claim 1, further comprising a second elastic member being coupled to said panel, said second elastic member being coextensive with said bottom side, said second elastic member urging said bottom side to frictionally engage said toilet such that said panel is removably retained on said toilet.

8. The system according to claim 6, wherein a pair of second couplers, each of said second couplers being coupled to said panel, each of said second couplers being coextensive with an associated one of said first lateral side and said second lateral side, each of said second couplers being complementary such that said panel is removably retained on said toilet.

9. A dirt shield system comprising:

a toilet having a pedestal, a bowl and a tank, said bowl extending upwardly from said pedestal, each of said pedestal and said bowl having an outer surface, said pedestal having a lower edge, said bowl having a distal edge with respect to said pedestal; and a cover being removably wrapped around said toilet, said cover being positioned to cover said bowl and said pedestal wherein said cover is configured to prevent said bowl and said pedestal from becoming soiled, said cover comprising:

a panel, said panel being flexible, said panel having a first surface, a second surface and a peripheral edge extending between said first surface and said second surface, said peripheral edge having a top side, a bottom side, a first lateral side and a second lateral side, said panel being curved between said first lateral side and said second lateral side such that said panel has a U-shaped cross section taken along a line extending between said top side and said bottom side, said panel having a bowl portion, a pedestal portion and a base portion, said bowl portion extending between said pedestal portion and said top side, said bowl portion curving outwardly between said pedestal portion and said top side, said base portion extending between said pedestal portion and said bottom side, said base portion curving outwardly between said pedestal portion and said bottom side, panel being wrapped around said toilet such that said first surface corresponding to said bowl portion abuts said outer surface corresponding to said bowl, said first surface corresponding to said pedestal portion abutting said outer surface corresponding to said pedestal, said top side being coextensive with said distal edge of said bowl, said bottom side being coextensive with said lower edge of said pedestal such that said panel completely covers said outer surface corresponding to said bowl and said pedestal, said first lateral side and said second lateral side being matable when said panel is wrapped around said toilet, a pair of first straps, each of said first straps extending upwardly from said top side, each of said first straps being positioned proximate an associated one of said first lateral side and said second lateral side, each of said first straps being wrapped around said toilet such that each of said first straps extends between said bowl and said tank, each of said first straps having a distal end with respect to said top side, said distal end of each of said first straps being matable such that said panel is removably retained on said toilet, a pair of first couplers, each of said first couplers being coupled to an associated one of said first straps, each of said first couplers being positioned adjacent to said distal end of said associated first strap, each of said first couplers being complementary, a first elastic member being coupled to said panel, said first elastic member being coextensive with said top side, said first elastic member urging said top side to frictionally engage said toilet such that said panel is removably retained on said toilet, a second elastic member being coupled to said panel, said second elastic member being coextensive with said bottom side, said second elastic member urging said bottom side to frictionally engage said toilet such that said panel is removably retained on said toilet, and a pair of second couplers, each of said second couplers being coupled to said panel, each of said second couplers being coextensive with an associated one of said first lateral side and said second lateral side, each of said second couplers being complementary such that said panel is removably retained on said toilet.

* * * * *